United States Patent [19]

Piestrup et al.

[11] Patent Number: 4,951,304

[45] Date of Patent: Aug. 21, 1990

[54] FOCUSED X-RAY SOURCE

[75] Inventors: Melvin A. Piestrup, Woodside; David G. Boyers, Mountain View; Cary I. Pincus, Sunnyvale; Pierre Maccagno, Stanford, all of Calif.

[73] Assignee: Adelphi Technology Inc., Palo Alto, Calif.

[21] Appl. No.: 378,907

[22] Filed: Jul. 12, 1989

[51] Int. Cl.[5] ..... G21K 1/00

[52] U.S. Cl. ..... 378/119; 378/84; 378/145

[58] Field of Search ..... 378/119, 145, 84, 85

[56] References Cited

U.S. PATENT DOCUMENTS 4,763,344 8/1988 Piestrup .

OTHER PUBLICATIONS

M. A. Piestrup, P. F. Finman, A. N. Chu, T. W. Barbee, Jr., R. H. Pantell, R. A. Gearhart, F. R. Buskirk, "Transition Radiation as an X-Ray Source," IEEE, Quant. Electr., vol. 19, pp. 1771–1781.

Alan G. Michette, "Optical Systems for Soft X-Rays," (Plenum Press, N.Y., 1986) Chapt. 2 and 3, pp. 37–94.

R. H. Pantell and P. S. Chung, "Transmission of X-Rays Through Curved Waveguides," IEEE J. of Quant. Electr., vol. QE-14, pp. 694–697, Sep. 1978, T. W. Barbee, Jr., "Multilayers for X-Ray Optical Applications," Springer Series in Optical Sciences, vol. 43:X-ray Microscopy, ed. G. Schmahl, D. Rudolph, pp. 144–161, 1984.

M. L. Cherry, D. Muller and T. A. Prince, "Transition Radiation from Relativistic Electrons in Periodic Radiators," Phys. Rev. D, vol. 10, pp. 3594–3607, Dec. 1974.

*Primary Examiner*—Craig E. Church

*Attorney, Agent, or Firm*—Joseph H. Smith

[57] ABSTRACT

An intense, relatively inexpensive X-ray source (as compared to a synchrotron emitter) for technological, scientific, and spectroscopic purposes. A conical radiation pattern produced by a single foil or stack of foils is focused by optics to increase the intensity of the radiation at a distance from the conical radiator.

5 Claims, 8 Drawing Sheets

FOCUSED X-RAY SOURCE

This invention was made with Government support under contract No. DE-AC03-85ER80234, awarded by the Department of Energy. The Government has certain rights to this invention.

TECHNICAL FIELD

This invention relates to an apparatus which uses transition radiation and special focusing optics for the production of high intensity X-rays for technological, scientific, and spectroscopic purposes.

BACKGROUND OF THE INVENTION

In the prior art, synchrotron radiation is probably the best known source available for scientific applications, such as spectroscopy, in the X-ray region of the electromagnetic spectrum. The properties of synchrotron radiation which make it so useful are its spectrum, high intensity, collimation, and time structure. Before the advent of synchrotron radiation, the only sources available for spectroscopy were line sources from conventional X-ray tubes which left large gaps in the spectrum. Synchrotron radiation filled these gaps because of its continuous spectrum, which extends from this infrared to hard X-rays.

Unfortunately, synchrotron sources require massive, costly machines. The electron beam energy must be large ($E>2$ GeV), and special and costly optics must be built to extract the X-rays from the ring.

In the prior art, transition randiation has been considered as an alternate source of soft and hard X-rays by M. A. Piestrup, P. F. Finman, A. N. Chu, T. W. Barbee Jr., R. H. Pantell, R. A. Gearhart, and F. R. Buskirk in "Transition Radiation as an X-ray source," IEEE, Quant. Elect. vol. 19, pp. 1771–1781, December 1983, and by M. A. Piestrup in patent application 893,977, "A new X-ray source using high density foils."

The X-ray radiation from such a source is similar to synchrotron emission in that it produces a continuous spectrum. In some cases transition radiation can produce more photons per electron than synchrotron radiation. However, synchrotron radiators can produce more total photons than transition radiators because the storage rings used for producing synchrotron radiation can have a much higher current than the linear accelerators used for producing transition radiation. Thus, in general, synchrotron emitters have higher intensity than transition radiators.

The radiation from a transition source is emitted in a conical radiation pattern which diverges roughly as the ratio of the electron's rest energy, $E_o$, to the electron's total energy E: $\theta=E_o/E$. This radiation pattern is shown in FIG. 1. For example, in electron beams of 50 MeV, the apex cone angle would be approximately 10 milliradians and the spot size of the radiation would be approximately 2 cm in diameter at a distance of 1 meter from the source. Thus, the radiation intensity would decrease as one gets farther from the foil stack. Synchrotron radiation comes from a curved trajectory, and hence is smeared in one plane.

In the prior art, reflectivities of X-rays from single single surfaces at normal or near normal incidence are very small. High reflectivities can be obtained using grazing angles of incidence. This is because at X-ray wavelengths the refractive index of the reflecting medium is very close to, and slightly less than, that of the surrounding medium (vacuum)—the conditions under which total external reflection can occur.

Grazing incidence optics have been used to make X-ray microscopes, X-ray telescopes and X-ray waveguides. In most of these applications, the reflecting optics consists of cylinders of revolution of varying diameters with straight or elliptical longitudinal surfaces. For example, soft X-ray microscopes have been used to image biological specimens. Early such instruments used cylindrical grazing angle optics. See Alan G. Michette, "Optical Systems for Soft X-Rays," Plenum Press, New York, 1986, Chapters 2 and 3, pp. 37–94.

The use of critical angle reflection has been applied to the design and fabrication of X-ray waveguides. For example, a hollow air-filled glass capillary tube with a 200-$\mu$m bore has been used to transmit soft X-rays a distance of 30 cm. See R. H. Pantell and P. S. Chung in IEEE Jounal of Quantum Electronics vol. QE-14, p 694, 1978.

SUMMARY OF INVENTION

In accordance with the preferred embodiment of the invention, the intensity (watts/cm$^2$) of transition radiation can be dramatically increased by focusing the unique conical radiation pattern of transition radiation using some elegantly simple optics. The cost of such a system would be considerably lower than a synchrotron source, and can produce intensities comparable to that of synchrotron. Thus the transition radiation source with focusing optics has most of the properties of the synchrotron source including a continuous spectrum, high intensity, and low divergence, but not the high cost of construction and operation.

The apparatus has a transition radiation source which generates X-rays in a conical radiation pattern. The transition radiator usually consists of multiple thin foils separated either by a gas or vacuum. An electron beam usually housed in a vacuum pipe strikes the thin foils, thus generating the X-rays, which are then collected by the optics which focus the radiation an appreciable distance from the radiator.

In one embodiment, the optics includes a smooth-bore tube composed of a solid such as metal, glass, or quartz. X-ray focusing is achieved by having the X-rays strike the surface of the tube at a grazing angle such that the X-rays are almost entirely reflected. The nature of a diverging cone traversing down the axis of a cylinder of revolution and intersecting the cylinder is such that an appreciable amount of the radiation will be reflected and focused.

The focused spots' dimensions are on the order of the emitting electron beam dimensions at the transition radiation foil stack. Spots of 0.3 to 2 mm diameter have been obtained at a distance of 1.35 meters from a transition radiator. Smaller spot sizes are possible. These sizes result in a large increase in the intensity at the focus.

Theoretical and experimental analyses have shown that a cone of radiation emitted from a finite diameter electron beam and intersecting a simple cylinder or tube (with both the cylinders' and cones' axes of revolution made to be coaxial) will result in the radiation being collected and focused. At first glance, one might suppose that no single point of focus would be achieved and that the various rays of the emitted cone would be dispersed along the axis of the focusing cylinder. However, because the cone of radiation is of small angular divergence, the focus of the radiation is almost the same diameter of the emitting electron beam even though the focus is somewhat dispersed laterally along the axis of the focusing optic.

A unique and fundamental concept behind this invention is that the low divergence cone of transition radiation can be easily focused by grazing-angle cylindrical optics. No other known X-ray source allows almost the entire emitted radiation pattern to be focused. Synchrotron radiators, conventional X-ray tube Bremsstrahlung, and characteristic line sources cannot have their entire radiation patterns focused. Almost all the radiation of these sources is discarded when the radiation is collimated or focused.

The optics are designed to capture almost the entire radiation cone and focus it either to a spot, line, or other configuration depending upon the desired application of the source. Thus the optics are designed to be adaptable to the conical radiation pattern and to the desired shape of the focus.

An important concept of the invention is that the optics are designed to optimize the efficiency of delivering the conically emitted X-rays to the focus. The benefit is that a relatively weak source of X-rays with an unusual conical radiation pattern is made to deliver intense, focused X-rays.

An additional benefit is that the high intensity X-rays can be transported to a large distance from an area of dangerously intense ionizing radiation (other than the desired X-rays) caused by the electrons striking the transition radiator, the electron beam pipe, and the electron beam dump. This is important since the electron beam producing the X rays at the target must be "dumped" or separated from the photon beam before the X-rays can be used.

The efficiency of collecting the X-rays can be improved in another embodiment by longitudinally curving the optics surface. For example, this can be done by making the optical element an elliptical or spherical surface of revolution. This can also be accomplished by segmenting the surface such that the segments approximate an elliptical surface of revolution.

The reflectivity of the surfaces of the optical element can be increased by coating the optical surfaces with thin layers of materials. Such coated surfaces are known as layered synthetic media (LSM) and are usually composed of alternating layers of two solids. The X-rays are Bragg reflected at each interface. The result is that the X-rays can be more efficiently reflected at larger grazing angles. (See T. W. Barbee Jr., Multilayers for X-ray Optical Applications, Springer Series in Optical Sciences, Vol. 43: X-ray Microscopy, Editors: G. Schamahl and D. Rudolph, pp. 144–161. Springer-Verlag Berlin Heidelberg 1984.)

Hence, the invention provides an apparatus which produces a high intensity (watts/cm$^2$) X-ray source for technological, scientific, and spectroscopic purposes which is relatively inexpensive and less complex than synchrotron sources, and relatively brighter than conventional X-ray tube sources.

DESCRIPTION OF PREFERRED EMBODIMENTS

Figure 2:
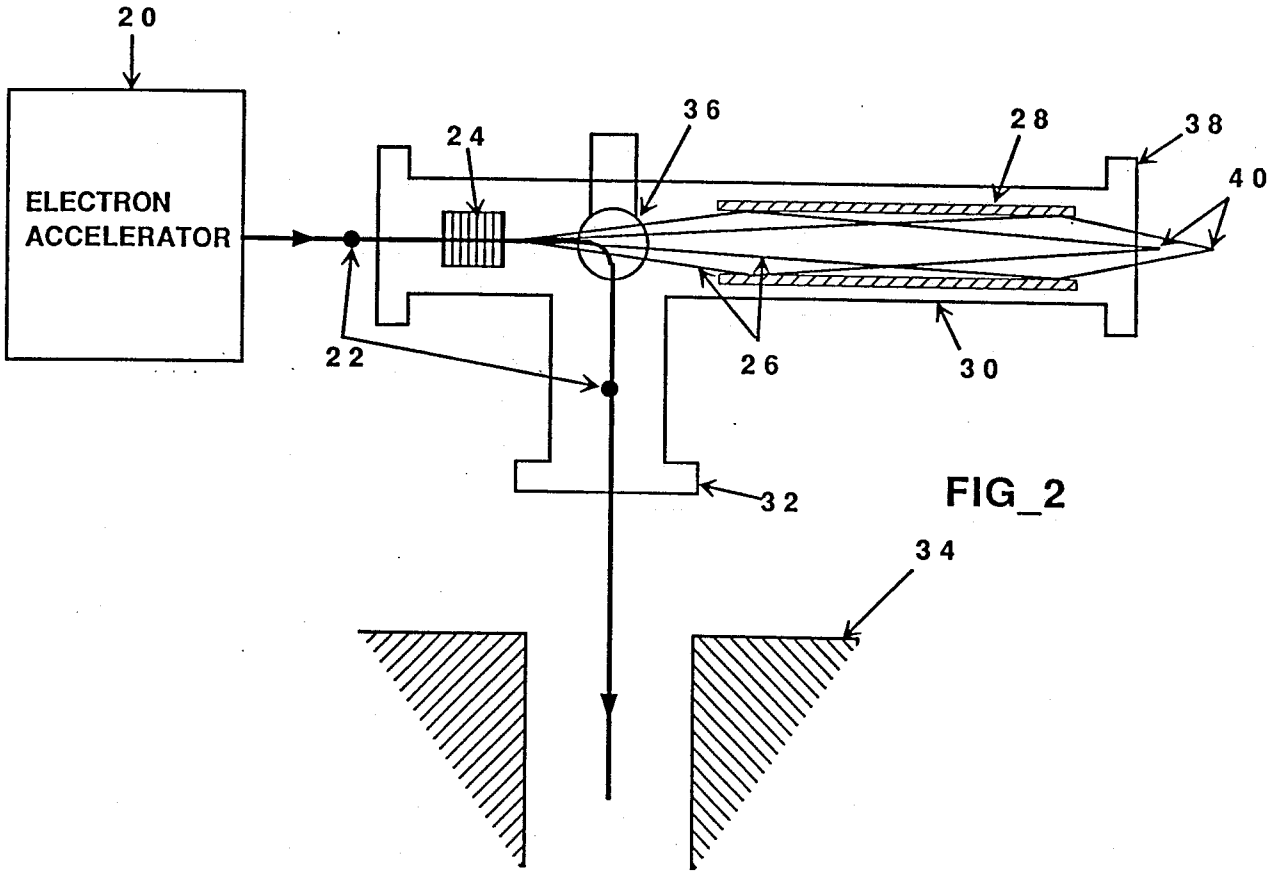
FIG. 2 shows a side view of an X-ray source according to the invention.

FIG. 2 shows a focused X-ray source which employs an electron beam 22 obtained from an accelerator 20. The electron beam is relativistic with $E>1$ MeV. The beam 22 is passed through thin foils 24, producing X-rays 26 in a conical radiation pattern. In the preferred mode, the foils 24 are made of various materials including beryllium, aluminum, or copper. These foils 24 typically vary in thickness from about 0.5 to about 10 $\mu$m and have a diameter large enough to permit the passage of the electron beam 22 without obstruction. The electron beam 22 passes through the thin foils 24 without stopping because of its high energy.

The X-rays 26 are separated from the electron beam 22 by bending the electrons with a bending magnet 36. In this embodiment, the electron beam 22 is bent 90° and exited out a window 32 into a suitable hole in the floor or beam dump 34 where the electrons are safely deposited with a minimum of back-scattered radiation. The X-rays 26 continue expanding in a conical fashion and striking the cylindrical optics 28 at slight grazing angles, say $\theta$, such that $\theta<\omega_p/\omega$, where $\omega_p$ is the plasma frequency of the cylindrical optics and $\omega$ is the frequency of the radiation. In this embodiment, the cylindrical optics is a single, smooth-bore quartz tube aligned with its axis along the trajectory of the electron beam 22 if the magnet 36 were turned off. This is also along the axis of revolution of the radiation cone.

Figure 3:
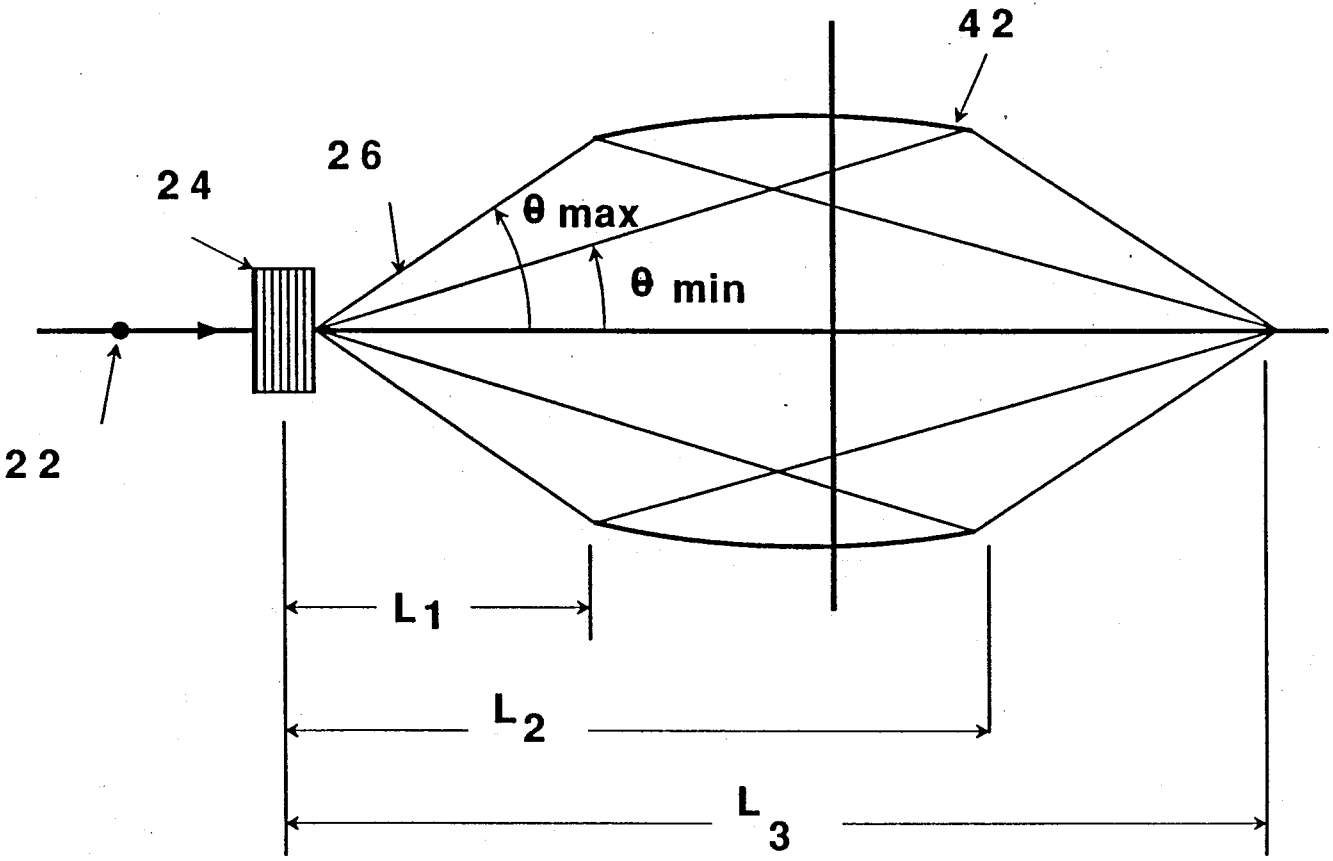
FIG. 3 shows a side view of the longitudinally curved cylindrical optics for point-to-point focusing.

The X-rays 26 are reflected off the cylindrical optics 28 and are focused at a point just outside the end of the cylinder 28. For this embodiment using the quartz tube for cylindrical optics, the focal points are distributed over a short range. FIG. 3 shows an embodiment with the optics slightly curved. In this embodiment, the radiation can be focused point to point; i.e., all the X-rays can be focused at a single point outside the cylindrical optics.

For transporting the electron beam and the X-rays, the device includes a housing consisting of vacuum pipe 30. In this embodiment the X-rays are allowed to escape out an exit window 38 into the atmosphere. In the preferred mode, the window is made up of thin, low X-ray absorbing foils such as aluminum. In other embodiments the X-rays 26 can be focused inside the vacuum.

In still another embodiment, the vacuum can be replaced by a low-density gas such as helium, which does not absorb the X-rays and minimally scatters the electrons.

OPERATION OF INVENTION

X-rays are produced by transition radiation when high energy electrons cross the interface between two media or between vacuum and a medium. The photon production for a single interface is small; however, by stacking a number of foils, the yield can be greatly increased. In most applications, individual foils separated by vacuum are used to reduce re-absorption of the X-rays in the medium.

The photon production from transition radiation is intimately related to the thickness of an individual foil, not only due to re-absorption of the emitted radiation in the foils themselves, but also because a minimum thickness (known as the formation length) is needed for photon production. Re-absorption can be minimized by making the foils as thin as possible; however, if they are made thinner than the formation length, the photon production will drop. Thus, there is an optimum foil thickness that balances production with re-absorption, giving a maximum photon yield. For soft X-rays, the thicknesses used in previous studies were between 0.5 and 5 $\mu$m. There are discussions of the construction of transition radiators in M. L. Cherry, D. Muller, and T. A. Prince, "Transition Radiation from relativistic electrons in periodic radiators," Phys. Rev. D., vol. 10, pp. 3594–3607, December 1974 and in the previous cited patent by Piestrup, and in IEEE Quant. Elect. paper by Piestrup et al.

In general, the radiator will be of thin foils of thickness $l_2$ and plasma frequency $\omega_2$ separated by either a gas or vacuum of thickness $l_1$ and plasma frequency $\omega_1$ (for the gas). For the usual case, when $l_1 >> l_2$ and $\omega_2 >> \omega_1$, then the radiation is emitted at frequencies $<\gamma\omega_2$. This frequency represents a cutoff frequency above which the radiation falls dramatically. Since the plasma frequency of a material is proportional to the square root of its density, this cutoff frequency is proportional to the square root of the foil density. For beryllium foils, $\omega_2 = 24.5$ eV, and a $\gamma$ of 50 to 100 is needed for adequate photon production at 1.5 keV.

The spectral intensity produced by a single electron traversing a single foil interface is given by Cherry et al. to be:

$$\frac{d^2N_0}{d\Omega d\omega} = \frac{\alpha\theta^2\omega}{16\pi^2c^2}(z_1 - z_2) \tag{1}$$

where $z_1$ and $z_2$ are the formation lengths of two dielectrics given approximately by:

$$z_i = \frac{c}{\omega\left(\frac{1}{\gamma^2} + \frac{\omega_i^2}{\omega^2} + \theta^2\right)}, \tag{2}$$

where i=1, 2, $\theta$ is the angle of emission with respect to electron trajectory, $\omega$ is the angular frequency of the radiation, $\omega_i$ (i=1,2) are the plasma frequencies of the two dielectrics, $\alpha$ is the fine structure constant ($\alpha = 1/137$), c is the speed of light, $N_o$ is the number of generated X-ray photons, $\Omega$ is the solid angle in steradians, $\gamma \simeq E/0.511$, and E is the electron beam energy in MeV. For M foils, and neglecting possible absorption and coherent phase addition between foils, the total flux from a stack of M foils would be $2MdN_o/d\Omega d\omega$.

Figure 1:
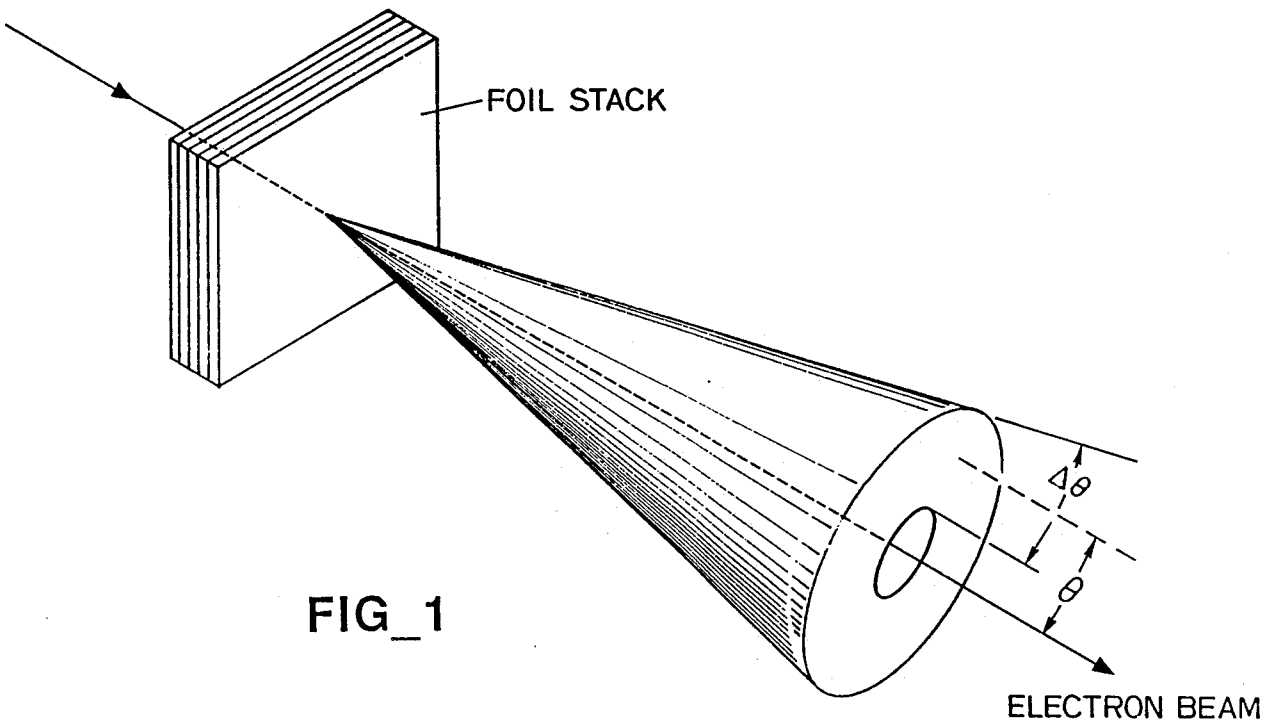
FIG. 1 shows X-rays being generated in a conical radiation pattern by charged particles striking thin foils.

As shown in FIG. 1, transition radiation is emitted in a tight forward cone. The cone angle of peak emission is found by taking the derivative of $d^2N_o/d\Omega d\omega$ with respect to $\theta$ and setting the expression to zero. The angle of maximum emission is then found to be:

$$\theta_p^2 = \frac{1}{3}\{-(\delta_1 + \delta_2) + [(\delta_1 + \delta_2)^2 + 12\delta_1\delta_2]^{\frac{1}{2}}\} \tag{3}$$

where

-continued $$\delta_i = \frac{1}{2\gamma^2} + \frac{\omega_i^2}{2\omega^2}, \; i = 1,2.$$

For $\gamma << \omega/\omega_i$, the angle of peak emission is given by $\theta_p \simeq 1/\gamma$. Its angular width is also $\Delta\theta \simeq 1/\gamma$. For 50-MeV electrons, $\theta = \Delta\theta = 10$mr; thus, at one meter away from the stack, the radiation would illuminate an annulus of approximately 3 cm$^2$.

The conical radiation pattern of transition radiation adapts easily to the geometry of cylindrical optics, and its small divergence makes the use of grazing-angle optics possible. At X-ray wavelengths, materials have an index of refraction that is less than unity, thereby allowing total reflection at a vacuum-material interface. The complex index of refraction, n, for a medium at X-ray wavelengths may be written as $$n = 1 - \delta - i\beta \tag{4}$$

where $\delta$ and $\beta$ are positive. If $\beta$ is negligible, total reflection from vacuum-to-medium occurs if the angle of incidence $\theta$ is less than the critical angle $\theta_c$, where:

$$\theta_c = \sqrt{2\delta} \simeq \frac{\omega_p}{\omega}, \tag{5}$$

and $\omega_p$ is the plasma frequency of the optics medium and $\omega$ is the frequency of the radiation. For the purposes of this description, the grazing angle is defined as the angle between the reflecting optics surface and the incoming X-ray beam whose angular value is sufficiently small that reflection of the X-ray beam occurs at said surface and is not absorbed. For the case where the optic element is composed entirely of a solid such as quartz, the maximum angle is given by $\theta_c$. Thus in this case the grazing angle would be angle an $\theta$, which is less than $\theta_c$.

With a quartz tube with $\omega_p = 33.2$ eV the critical angle is $\theta_c = 16.61$ mr for 2 keV X rays. X rays hitting the surface with angles at or less than the critical angle will be reflected at nearly 100% efficiency. Conventional X-ray tubes produce X-rays that are highly divergent and such a reflector is almost useless. However, in the present invention the divergence of the transition-radiation cone is small and circularly symmetric around the axis defined by the electron beam—which is an ideal geometry for capture by a hollow cylindrical optic. By placing a quartz tube along the cone's axis the X rays can be reflected and focused. This is illustrated by the ray-tracing diagram shown in FIG. 4. The radiation cone is intercepted by the quartz tube and focused a distance away from the radiator.

Two methods have been developed to determine the diameter, length, and proper placement of a cylindrical optic used to focus transition radiation produced by a finite diameter electron beam. Focusing optics made and placed according to these dimensions will give high intensity at the focus point. These designs are not necessarily the only algorithms possible. There can be considerable variations in the dimensions calculated using the formulas presented next. The factors that influence the dimensions are electron beam energy, foil stack specifications, diameter of the beam at the foil stack, and the distance from the foil stack to the chosen point of focus.

Method 1: Maximum Peak Flux with Short Optics

The purpose is to maximize the amount of flux that is collected by the focusing cylinder. By noting at which angles most of the flux is present, the optimum length and placement of the cylinder can be determined. At first glance the optimum angle would be the angle of peak emission, $\theta_p$, as given by eqn (3). However, since the flux is emitted in an annulus, larger radial angles result in large areas of emission, and, hence, larger numbers of photons. In other words, more photons are emitted for angles slightly larger than $\theta_p$, because there is more area of emission. Thus in order to maximize the flux one must design the optics to capture this additional flux.

The additional photons are the result of the fact that there is more area outside of $\theta_p$ in the annulus. By multiplying the spectral intensity for a single interface (eqn. 1) by $\theta$, we take into account the increase in number of photons as we go to larger angles. Taking the derivative of this weighted spectral intensity with respect to $\theta$ and setting the results to zero, one obtains the optimum angle of emission for collecting the most radiation:

$$\theta_{opt}^2 = \frac{1}{5}\{-(\delta_1 + \delta_2) + [(\delta_1 + \delta_2)^2 - 60\delta_1\delta_2]^{\frac{1}{2}}\} \quad (6)$$

where $$\delta_i = \frac{1}{2\gamma^2} + \frac{\omega_i^2}{2\omega^2}, \; i = 1,2.$$

Figure 4:
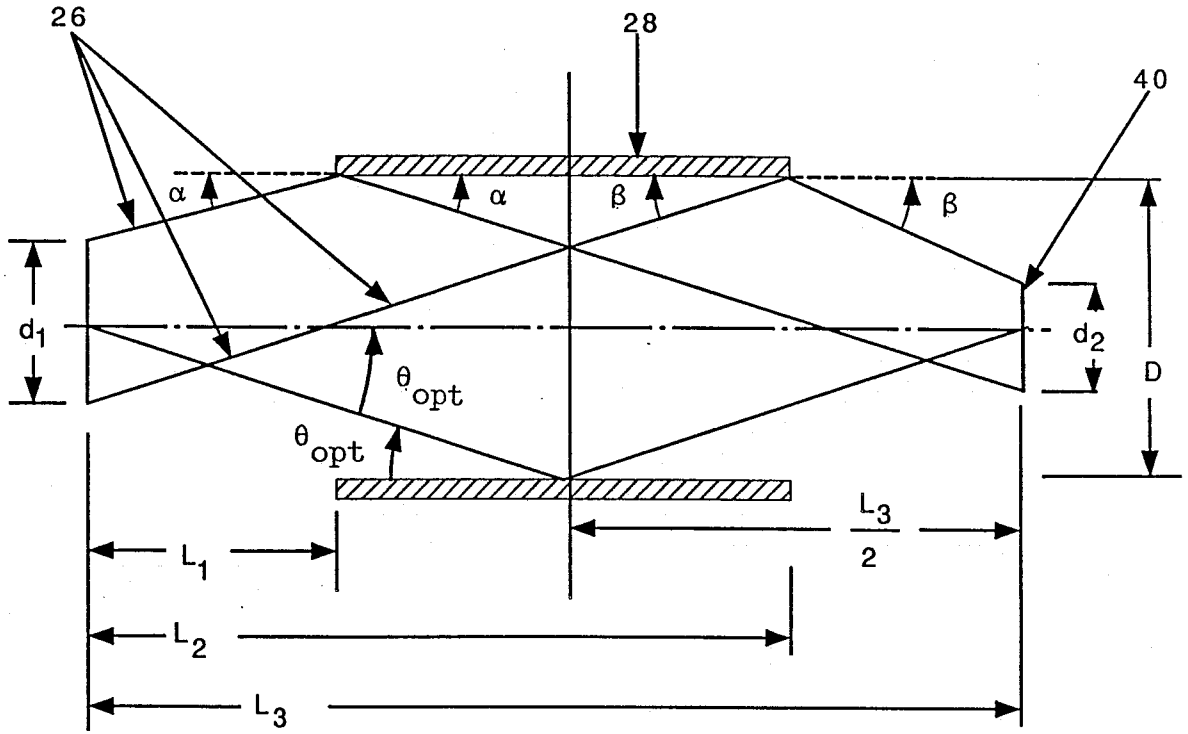
FIG. 4 is a ray tracing diagram used to determine position and size of the cylindrical optics given the diameter, d, of the electron beam and the desired position of the focus, $L_3$.

Then use $\theta_{opt}$ to determine the geometry shown in FIG. 4 to determine $L_1$, $L_2$, $L_3$, and D given a finite electron beam diameter, $d_1$, and finite focal spot diameter $d_2$.

From FIG. 4, note that $$D = L_3 \tan \theta_{opt} \quad (7)$$

Given D, one can now find $L_1$ and $L_2$, the dimensions necessary to reflect extreme rays to the point of focus. Solving for tan $\alpha$:

$$\tan\alpha = \frac{D - d_1}{2L_1} = \frac{D + d_2}{2(L_3 - L_1)} \quad (8)$$

shows that:

$$L_1 = \frac{L_3(D - d_1)}{2D + d_2 - d_1} \quad (9)$$

Solving for the other extreme ray:

$$\tan\beta = \frac{D + d_1}{2L_2} = \frac{D - d_2}{2(L_3 - L_2)} \quad (10)$$

it can be shown that:

$$L_2 = \frac{L_3(D + d_1)}{2D + d_1 - d_2} \quad (11)$$

Thus, given $d_1$, $d_2$, and $L_3$, one obtains the tube length $L = L_2 - L_1$ and its position $L_2$, $L_1$.

The method of calculating D, $L_1$ and $L_2$ follows: the optimum angle of emission for collecting most of the radiation, $\theta_{opt}$, is calculated from eqn. (6). The parameters needed to determine $\theta_{opt}$ are the electron beam energy, the plasma frequency of the foil material, and spacing medium ($\omega_1 = 0$ for a vacuum spacing), and the angular frequency of maximum photon emission. The latter can be determined from the plotting of the photon emission as a function of angular frequency. Once $\theta_{opt}$ has been calculated the diameter, D, of the cylinder can be calculated knowing the distance to the desired focal point, $L_3$, and using eqn. (7). Using the diameter of the electron beam, $d_1$, and the diameter of the focal spot, $d_2$, one can then calculate $L_1$ and $L_2$ from eqns. (9) and (11).

As an example, a focusing optics system was designed for the Saskatoon Accelerator Laboratory's (SAL) linear accelerator at Saskatoon, Canada.

A foil stack made up of 12 foils of 1.0 $\mu$m Aluminum was designed for the 200 MeV accelerator. The spectral intensity has been experimentally found to peak at 1500 eV. Using this peak frequency and knowing the plasma frequency and knowing the plasma frequency of Aluminum to be 31.2 eV, one calculates $\theta_{opt}$ to be 8.4 mr from equation (6). The distance from the Aluminum foil target and the focus is required to be 345 cm. From equation (7), the diameter of the tube is calculated to be D=29 mm.

The electron beam diameter at the foil stack is determined by the accelerator characteristics (beam emittance and energy) and focusing optics (magnet lenses). For the SAL accelerator, the beam diameter at the foil stack and the desired X-ray diameter are $d_1 = d_2 = 2$ mm. From equations (9) and (11), $L_1$ and $L_2$ are calculated to be $L_1 = 166$ cm and $L_2 = 178$ cm. Thus the minimum length of the tube is $L_2 - L_1 = 12$ cm.

Method 2. Complete Collection with Long Optics

As stated above, the algorithm for designing the cylindrical optic is not unique and depends upon the desired spot size and peak intensity of the focused cone. The calculated values for $L_1$ and $L_2$ result in a minimum length for the cylindrical tube. The tube can be extended all the way to the focal point and a considerable distance back to the foil stack. This will result in more of the X-ray cone being collected and reflected down the tube. However, most of these additional X-rays will not contribute appreciably to the small focal spot. Most of these X-rays will contribute to a residual background flux surrounding the sharp X-ray peak. This residual background appears as "shoulders" to the X-ray peak. Using the algorithm outlined above, the background or shoulders disappears from the X-ray peak.

The extended cylinder design to intercept most of the cone again uses the optimum angle of maximum photons to determine the diameter of the tube. $\theta_{opt}$ is used to determine D as was done in the previous algorithm using equation (7), $D = L_3 \tan \theta_{opt}$. Given D, $L_1$ and $L_2$ are determined approximately by noting at which angles the radiation falls to less than half of the peak value (this again is a matter of preference of how much of the cone is to be reflected). As stated previously, the angular width of the radiation cone is approximately $\Delta\theta = 1/\gamma$, thus the half peak values are $\alpha_1 = \frac{1}{2}\gamma$, $\alpha_2 = 3/2\gamma$. $L_1$ and $L_2$ are then given to be:

$$L_1 = \frac{D}{2\tan\alpha_1} \quad (12)$$

$$L_2 = \frac{D}{2\tan\alpha_2} \quad (13)$$

Thus given $L_3$, the tube length $L=L_2-L_1$ and its position can again be calculated. If $L_2$ is calculated to be $L_2>L_3$ then pick $L_2=L_3$. Thus the tube is brought right up to the focal spot.

Using the example of method 1, where the aluminum stack is again used (E=200 MeV, $\omega=1500$ eV, $\omega_p=31.2$ eV, $\theta_{opt}=8.4$ mr and D=29 mm) we calculate $L_1$ and $L_2$ from (12) and (13) to be: $L_1=154$ cm, and $L_2=461$ cm. Since $L_2>L_3$, we pick $L_2=L_3=300$ cm. The tube length would be L=146 cm.

Elliptical Optics

If it is desired that the total X-ray flux from the cone is to be focused, then the simple straight cylinder will not suffice and elliptical cylindrical optics must be used as shown in FIG. 3.

An elliptical cylinder with a smooth surface is more difficult to fabricate than a straight cylindrical tube. Quartz and glass tubes of various diameters and lengths are available from the commercial glass industry, whereas a cylinder with an elliptical must be fabricated using unusual grinding and polishing techniques. However, an elliptical surface of revolution can focus the entire transition radiation cone. This would increase the overall intensity of the focal spot by several orders of magnitude.

Figure 5:
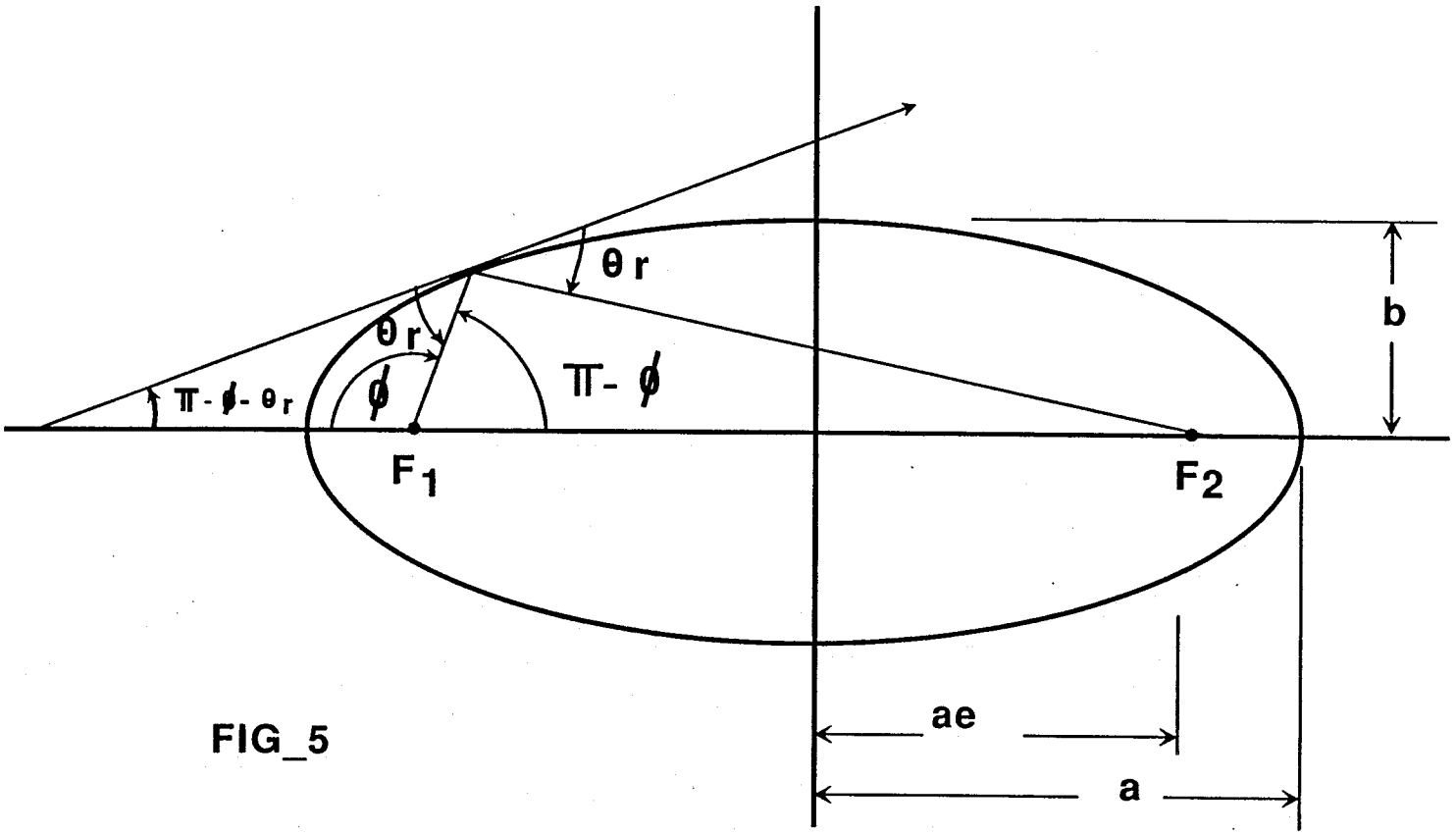
FIG. 5 shows an elliptical optical element.

How such an elliptical surface of revolution can reflect and focus the entire transition radiation cone can be seen from noting the general property of a two dimensional ellipse shown in FIG. 5. A ray emitted at one focus of an ellipse will be reflected and travel through the other focus. This is a well-known mathematical property of an ellipse. As in the straight cylinder case, reflection will occur for X-rays only if the angle of incidence is less than the critical angle, $\theta_c$, as given by (5). In order to reflect the entire radiation cone, one need only to make a surface of revolution around the major axis of the ellipse.

Given the parameters of the transition radiation cone, one can calculate the dimensions of the desired ellipse from the polar equation of the ellipse:

$$r = \frac{a(1-e^2)}{1+e\mathrm{Cos}\phi} \tag{14}$$

where a is the radius of the major axis, e is eccentricity of the ellipse, $x=-r\ \mathrm{Cos}\ \phi$, and $y=r\ \mathrm{Sin}\ \phi$.

The eccentricity of the ellipse can be calculated by obtaining the slope of the tangent to the ellipse, dy/dx.

$$\frac{dy}{dx} = \sin\phi\frac{dr}{dx} + r\cos\phi\frac{d\phi}{dx} \tag{15}$$

$$\frac{dr}{dx} = \frac{dr}{d\phi}\ \frac{d\phi}{dx}$$

$$\frac{dr}{d\phi} = \frac{r\sin\phi}{1+e\cos\phi}$$

$$\frac{dx}{d\phi} = r\sin\phi - \frac{r\sin\phi\cos\phi}{1+e\cos\phi},\ \frac{d\phi}{dx} = \frac{1+e\cos\phi}{r\sin\phi}$$

substituting $$\frac{dy}{dx} = \left(\frac{r\sin^2\phi}{1+e\cos\phi} + r\cos\phi\right)\cdot\frac{1+e\cos\phi}{r\sin\phi} \tag{16}$$

$$\frac{dy}{dx} = \frac{\cos\phi+e}{\sin\phi}$$

-continued $$= -\tan(\phi+\theta) \tag{17}$$

Solving for e, $e=-\tan(\theta+\phi)\sin\phi-\cos\phi$. The maximum transition radiation cone angle is approximately $\theta\simeq 3/2\gamma$ and the minimum angle is $\theta=\frac{1}{2}\gamma$. Substituting these limits in eqn. 17, one finds $$e = -\tan\left(\theta_c - \frac{1}{2\gamma}\right)\sin\left(\frac{1}{2\gamma}\right) + \cos\left(\frac{1}{2\gamma}\right) \tag{18}$$

If E=50 MeV, $\frac{1}{2}\gamma=5$ mr, and the elliptical optical element is made of quartz with a plasma frequency $\omega_p=33.2$ eV, and the X-ray photons have an energy of 2 keV, then $\theta_c=16.61$ mr. Using eqn. (18), one finds the eccentricity of the ellipse to be e=0.9999294. Given a value for a of 172.5 cm, then:

$$b = a\sqrt{1-e^2} = 2.05\ \mathrm{cm}. \tag{19}$$

Experimental verification has been obtained that the transition X-ray cone can be focused a large distance from the foil stack. This was done using an experimental apparatus at the Naval Post-graduate School (NPS) linac in Monterey Calif.

Figure 6:
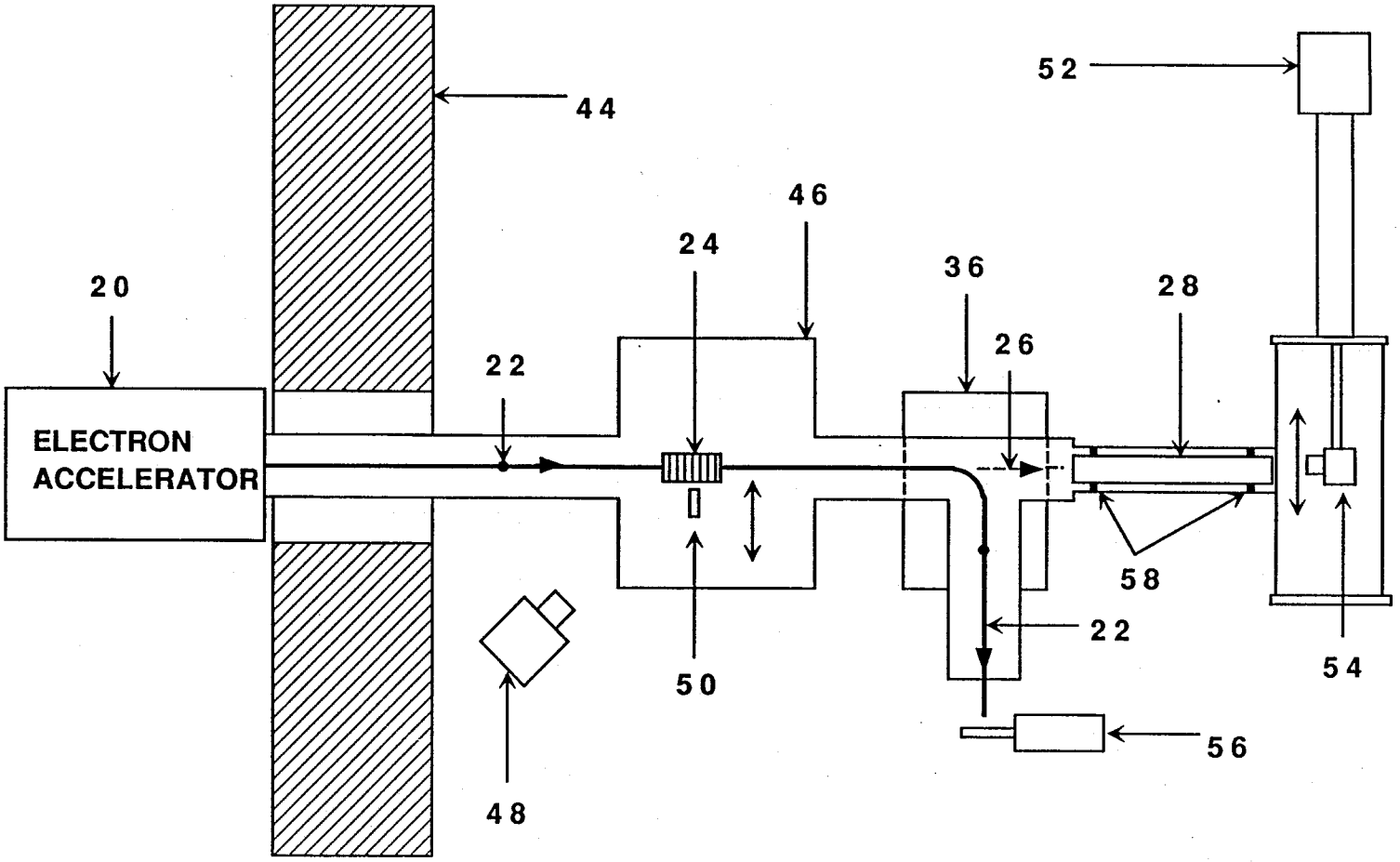
FIG. 6 shows the experimental apparatus.

The experimental apparatus shown in FIG. 6, includes an electron accelerator 20, mylar foil stack 24, foil stack chamber 46, bending magnet 36, and linear diode array X-ray detector 54. The foil stack chamber 46 was a scattering chamber designed for nuclear physics. The chamber has been used in previous transition-radiation experiments, and has several features that make it valuable for this work. It consists of a 24"-diameter vacuum chamber with associated vacuum pumps, and a target holder. At the center of the chamber there is a "target ladder" which can be raised and lowered. This allows a phosphor target 50 and up to four foil stacks to be placed in the electron beam path without breaking vacuum. The phosphor target 50 allows viewing of the position of the electron beam. Several viewing ports allow visual and video alignment of the tragets. A TV camera 48 was used for this alignment.

During the experiment the energy of the accelerator was to 93 MeV. The average current was $\simeq 0.1\ \mu$A with a 60-pps-repetition rate, and 1-$\mu$sec-pulse length.

The soft X-rays emitted from the mylar-foil stack 24 were collected by the cylindrical optics which in this case was a cylindrical quartz tube 28 with a 10-mm inside diameter and 12-mm outside diameter. The quartz tube 28 was mounted with the tube entrance $L_1=0.55$ m from the foil stack and tube exit $L_2=1.05$ m from the foil stack. Two metal rings, called cylindrical optics supports 58 hold and position the quartz tube 28.

A linear diode array 54 was utilized for detecting soft X-rays. The array was used to observe the angular distribution from an 8-foil mylar stack 24. This gave a "real-time", pulse-to-pulse, observation of the angular distribution in the photon energy range of 1 to 3 keV. Each detector element of the array has a photosensitive area 50 $\mu$m wide by 2.5 mm high, which subtends a solid angle of $6.86\times10^{-8}$ Str. for a source-to-detector distance of 1.35 m. The array can be translated 17 cm; however, since the array was 2.54 cm long, the entire cone was covered.

Figure 7:
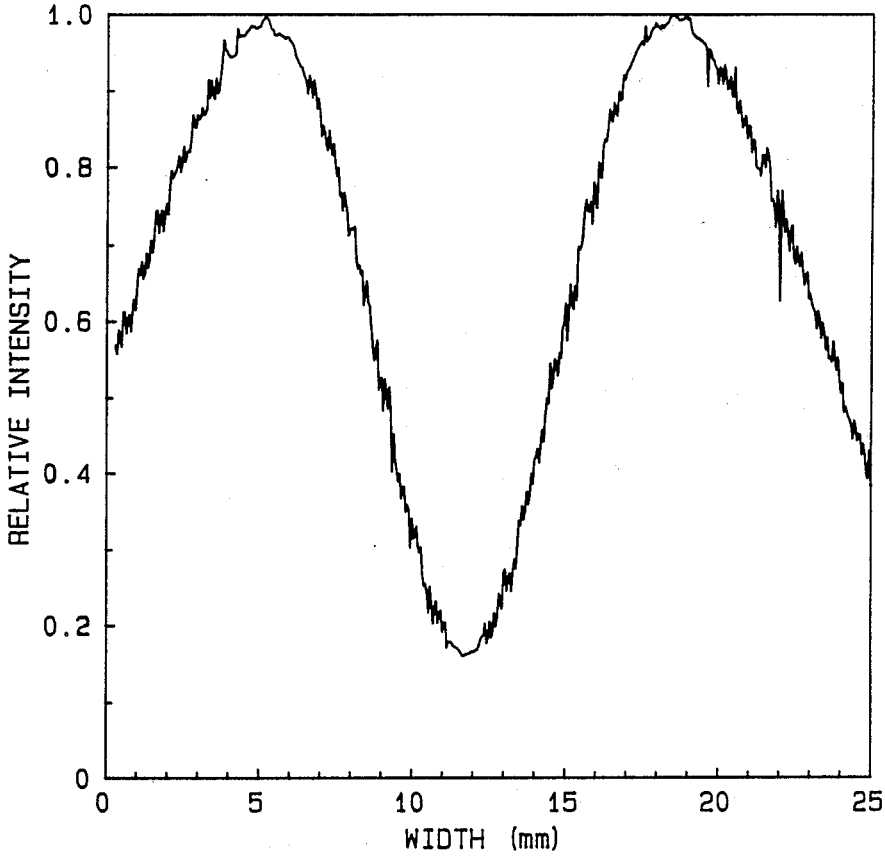
FIG. 7 shows a measured cross section of the conical radiation pattern.
Figure 8:
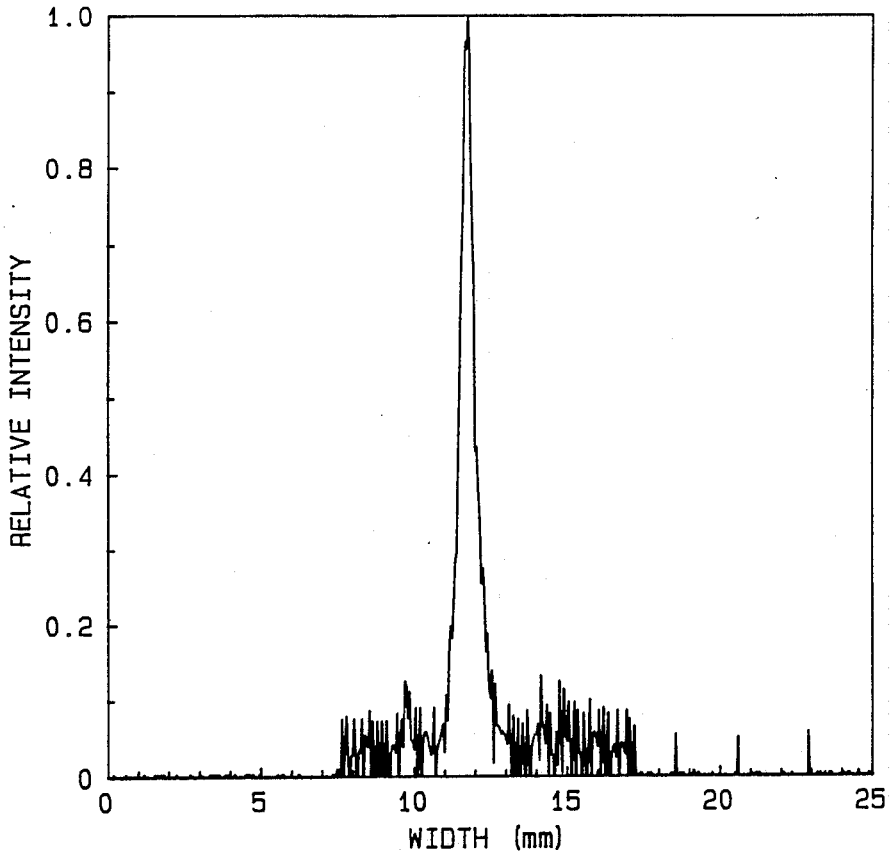
FIG. 8 shows a measured cross section of the focused radiation pattern.

The soft X-ray radiation patterns produced with and without the X-ray optics are shown in FIGS. 7 and 8, respectively. In the case of no X-ray optics (FIG. 7) one sees the familiar $1/\gamma$ cone of radiation with a peak brightness of 0.4 V corresponding to a photon flux of $1.3\times10^9$ photons/cm$^2$/sec at an average electron-beam current of 0.1 $\mu$A and energy of 91 MeV. With the cylindrical electron optics (FIG. 8) one sees a single peak of X-ray emission on axis with a FWHM of 2 mm and an amplitude of 2.5 V corresponding to a photon flux of $10^{10}$ photons/cm$^2$/sec at the same beam current and energy. If the beam current of 100 $\mu$A is used with a 20 foil stack of beryllium, an X-ray flux of $10^{12}$ photons/cm$^2$/sec/eV in a spot with a FWHM of 2 mm would be produced. If the diameter of the electron beam is 100 $\mu$m, then one expects that one can produce a focused spot of X-rays with a compatible FWHM and a brightness approaching $4\times10^{14}$ photons/cm$^2$/sec/eV.

What is claimed is:

1. An apparatus for generating high intensity X-rays comprising:

X-ray means for generating conical X-rays having a directional axis by transition radiation;

focusing means for focusing said X-rays having grazing-angle optics; and a housing means for holding said focusing means, an optical medium for the apparatus, and said X-ray means.

2. A source as in claim 1 wherein said optics comprises a cylinder of revolution whose axis of revolution lies along the directed axis of the said X-ray cone, said cylinder configured such that said cone intersects the inner surface of said cylinder at angles less than or equal to $\omega_p/\omega$, where $\omega_p$ is the plasma frequency of the optical medium and $\omega$ is the frequency of the X-rays.

3. A source as in claim 2 wherein the said cylindrical optics comprises of a smooth-bore tube composed of a material selected from the groups: metal, glass, or quartz.

4. A source as in claim 2 wherein the said cylindrical optics comprises of a cylinder of revolution whose longitudinal surface in the direction of the axis of revolution of the said cylindrical optics is curved to maximize the intensity of the X-rays at the focus.

5. A source as in claims 3, or 4 wherein the said optics are coated on their reflecting surfaces with thin layers of materials that increase the reflectivity of the X-rays from the said surfaces.

* * * * *